US006446445B1

(12) United States Patent
Phillips et al.

(10) Patent No.: US 6,446,445 B1
(45) Date of Patent: Sep. 10, 2002

(54) METHOD OF REDUCING THE DURATION OF THE THERMAL STABILIZATION PHASE OF A LIQUEFIED GAS CONVERTER

(76) Inventors: Robert John Phillips, 2 Parr Cottages, Feniton, Honiton, Devon EX14 0BD (GB); David John Peacey, 61 Burroughes Avenue, Yeovil, Somerset BA21 3TU (GB); Humphrey Albert Samuel Hamlin, 27 Bishopston, Montacute, Somerset (GB)

( * ) Notice: Subject to any disclaimer, the term of this patent is extended or adjusted under 35 U.S.C. 154(b) by 0 days.

(21) Appl. No.: 09/155,834

(22) PCT Filed: Jan. 28, 1998

(86) PCT No.: PCT/GB98/00246

§ 371 (c)(1),
(2), (4) Date: Jun. 25, 1999

(87) PCT Pub. No.: WO98/35179

PCT Pub. Date: Aug. 13, 1998

(30) Foreign Application Priority Data

Feb. 6, 1997 (GB) ..... 9702393

(51) Int. Cl.[7] ..... F17C 9/02
(52) U.S. Cl. ..... 62/50.2; 62/50.7
(58) Field of Search ..... 62/48.1, 50.2, 62/50.7, 78

(56) References Cited

U.S. PATENT DOCUMENTS

| | | | | | |
|---|---|---|---|---|---|
| 2,873,582 | A | * | 2/1959 | Green | 62/5 |
| 2,943,459 | A | * | 7/1960 | Rind | 62/217 |
| 2,951,348 | A | | 9/1960 | Loveday et al. | |
| 3,946,572 | A | | 3/1976 | Bragg | |
| 5,778,687 | A | * | 7/1998 | Waldron | 62/78 |

FOREIGN PATENT DOCUMENTS

| | | |
|---|---|---|
| DE | 2054402 | 5/1971 |
| GB | 872661 | 7/1961 |
| GB | 1262738 | 2/1972 |

* cited by examiner

*Primary Examiner*—Denise L. Esquivel
*Assistant Examiner*—Malik N. Drake
(74) *Attorney, Agent, or Firm*—Marshall, Gerstein & Borun.

(57) ABSTRACT

A method of reducing the duration of the thermal stabilization phase of a liquefied gas converter (13) is characterized in that the method comprises providing in a feed line (11) between a source (12) of liquefied gas and the liquefied gas converter (13), an uninsulated flow region (16) through which at least a portion of the liquefied gas passes during filling.

13 Claims, 1 Drawing Sheet

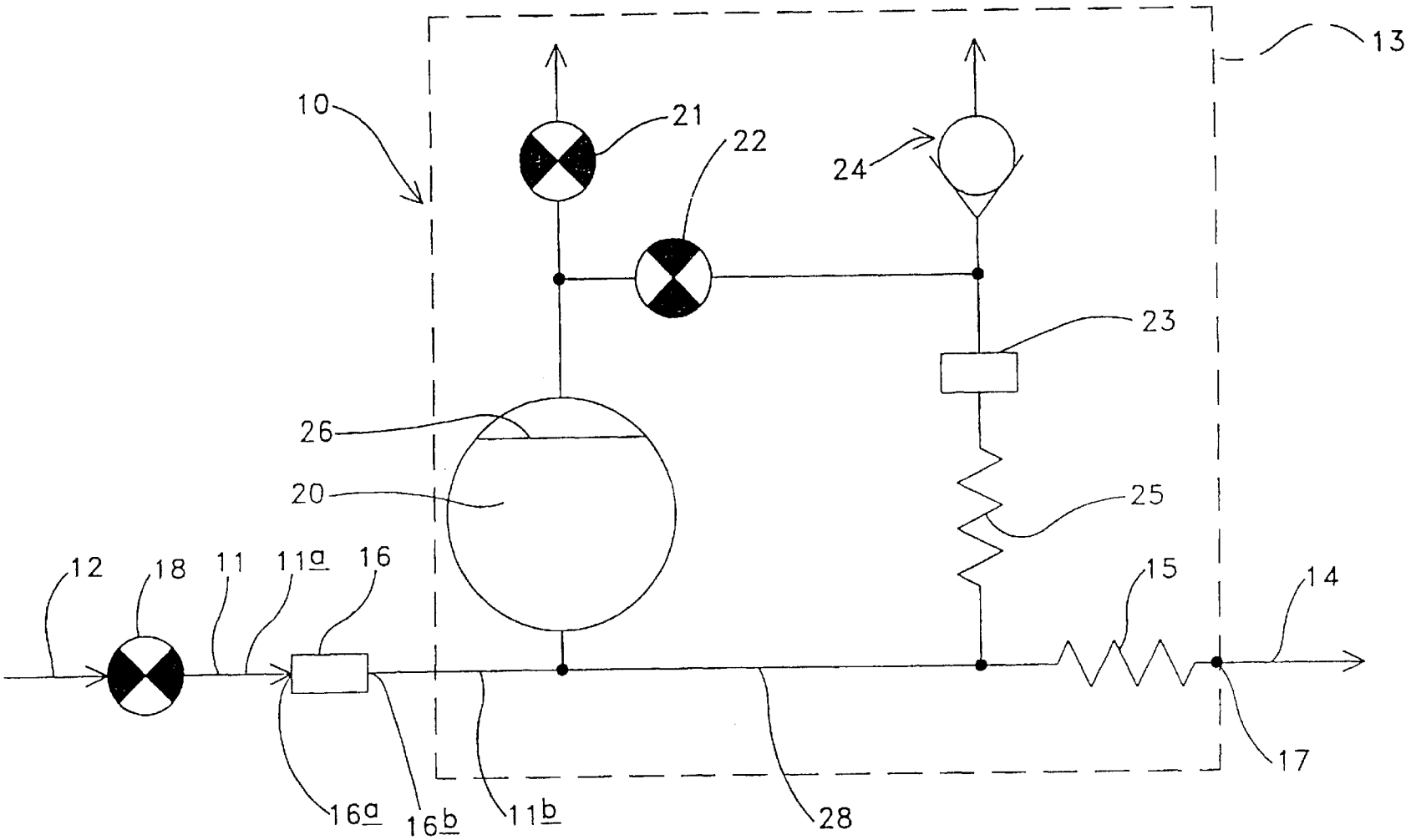
13
14
17
23
25
15
24
28
22
21
11b
16b
10
26
20
16
16a
11a
11
18
12

METHOD OF REDUCING THE DURATION OF THE THERMAL STABILIZATION PHASE OF A LIQUEFIED GAS CONVERTER

DESCRIPTION OF INVENTION

This invention relates to a method of and apparatus for reducing the duration of the thermal stabilisation phase of a liquefied gas converter and more particularly to such a method of and apparatus for converting liquefied oxygen to breathable oxygen gas.

Oxygen converters are well known and one such oxygen converter for use by an air crew in an aircraft is described in our previous patent GB 1303046. In the arrangement described, there is a liquefied oxygen store comprising an insulated dewar. When the dewar is filled with or topped up with liquefied oxygen, liquefied oxygen is fed via a valve, along a feed line, which includes an uninsulated container and a heat exchanger.

When the converter is in use, liquefied oxygen passes back along the feed line into the heat exchanger and uninsulated container where the liquefied oxygen gains heat and is converted into oxygen gas.

It will be appreciated by those skilled in the art that immediately after filling, only the surface layer of the liquefied oxygen is at a temperature consistent with the desired system pressure. As the liquefied oxygen has a low thermal conductivity, the subsequent thermal stabilisation phase when the temperature of the liquefied oxygen in the converter stabilises, can be of considerable duration, typically of about 24 hours in some known systems.

Where the oxygen converter is installed in an aircraft, during the thermal stabilisation phase the aircraft preferably is not used, as oxygen at an appropriate pressure for supply to the breathing system cannot be guaranteed until the thermal equilibrium of the liquefied oxygen bulk in the dewar is established. This is because disturbance of the liquefied oxygen, by vibration say during aircraft take off, tends to cause mixing of the surface layer and the remainder of the bulk. Thus the temperature of the surface layer would be reduced resulting in a loss of pressure.

Various methods have been utilised to reduce the duration of the thermal stabilisation phase. All of these essentially involve increasing the temperature of the liquefied bulk towards the surface layer temperature. For example, in our previous patent GB 1303046, during filling, as the liquefied oxygen passes through the uninsulated container and the heat exchanger of the liquefied oxygen converter, heat energy is gained.

In each existing design of liquefied oxygen converter a unique approach has to be taken to reducing the duration of the thermal stabilisation phase.

It is one object of the present invention to provide a method of and apparatus for reducing the duration of the thermal stabilisation phase of a liquefied gas converter which is more generally applicable.

According to a first aspect of the invention we provide a method of reducing the duration of the thermal stabilisation phase of a liquefied gas converter characterised in that the method comprises providing in a feed line between a source of liquefied gas and the liquefied gas converter, an uninsulated flow region through at least a portion of which the liquefied gas passes during filling.

Thus the duration of the thermal stabilisation phase of a liquefied gas converter can substantially be reduced without any adaptation of the existing liquefied gas converter. Thus the method is applicable irrespective of liquefied gas converter design and may be performed readily on existing systems.

Thus the method may include interrupting an existing feed line and connecting an inlet of the uninsulated flow region to a part of the feed line which extends to the liquefied gas store, and connecting an outlet of the uninsulated flow region to a pair of the feed line which extends to the liquefied gas converter. The inlet and outlet of the uninsulated flow region may be separate or combined.

Preferably the method includes locating the uninsulated flow region in an environment which is at ambient temperature. Thus the liquefied gas gains heat energy from the ambient environment as it flows through the uninsulated flow region.

According to a second aspect of the invention we provide an apparatus for reducing the duration of the thermal stabilisation phase of a liquefied gas converter having a liquefied gas feed line between a source of liquefied gas and the liquefied gas converter, and a product gas outlet characterised in that the apparatus comprises an uninsulated flow region located in the feed line through which at least a portion of the liquefied oxygen passes during filling of a liquefied gas store of the liquefied gas converter.

Thus the apparatus of the second aspect of the invention may be provided utilising an existing liquefied gas converter. The liquefied gas converter and the uninsulated flow region of the apparatus may be installed together or the uninsulated flow region may be retrofitted to an existing gas supply system.

The uninsulated flow region may have a capacity of between 5% and 15% of the volume of the liquefied gas store of the oxygen converter and more particularly may have a capacity of between 7% and 10% of the volume of the liquefied gas store of the oxygen converter. However it will be appreciated that in order to achieve a desired thermal stabilisation phase duration the preferred volume of the uninsulated flow region will depend on many other factors, including amongst others, the rate of filling, the temperature of the environment in which the uninsulated flow region is located and the effectiveness of insulation of the remainder of the feed line.

The uninsulated flow region may comprise a simple container through which at least a potion of the liquefied gas flows during filling, or particularly where there is a restriction of available space, for example in an aircraft, the uninsulated flow region may comprise an inlet and an outlet and a flow passage or passages between the inlet and the outlet of a length, or combined length which is substantially greater than the distance from the inlet to the outlet.

According to a third aspect of the invention we provide a method of adapting a gas supply system comprising a liquefied gas converter, a feed line to the liquefied gas converter for replenishing a liquefied gas store of the liquefied gas converter, and a product gas outlet for product gas produced by the liquefied gas converter, the method comprising installing in the feed line an uninsulated flow region through which at least a portion of the liquefied gas flows during filling of the liquefied gas store, whereby the duration of the thermal stabilisation phase of the liquefied gas converter subsequent to filling, is reduced.

The invention will now be described with reference to the accompanying drawings which is a diagrammatic representation of an apparatus of the second aspect of the invention.

Referring to the FIGURE there is shown an oxygen supply system 10 for use in an aircraft for producing gas for use for breathing by an air crew. However the invention has much wider application and may be applied to a system for supplying oxygen in other applications, or even to a system for supplying other than oxygen gas, such as more particularly, nitrogen gas.

The system comprises a feed line 11 along which liquefied oxygen may be passed from a liquefied gas source 12 to a liquefied oxygen gas converter 13 where the liquefied oxygen is converted into oxygen gas for breathing. The liquefied oxygen has an outlet 17 for product (oxygen) gas, which may pass along a supply line 14 having passed through a heat exchanger 15, for use. In the heat exchanger 15 the liquefied gas gains heat energy to convert the liquid to gas for use in a breathing system.

The system includes an inlet valve 18 through which the liquefied oxygen flows as a liquefied oxygen store 20 within the liquefied oxygen converter 13 is filled with liquefied oxygen, and which may be closed subsequent to filling to prevent the escape of liquefied oxygen from the system 10 and to permit the source of liquefied oxygen to be disconnected.

The liquefied oxygen converter 13 may be of any desired kind, but in this example includes a liquefied oxygen store vent valve 21 which may be opened during filling, to permit the escape of oxygen gas from the system 10 and which may be closed during a thermal stabilisation phase following filling.

As gas is used in the breathing system, liquefied oxygen passes from the store 20, along line 28 to the heat exchanger 15, where it is converted to oxygen gas. This results in a pressure loss in the converter 13 which is made up by liquefied oxygen also flowing into a pressure build-up circuit, via a heat exchanger 25. In the heat exchanger 25, some gas is produced which passes via a pressure control valve 23, through another valve 22, back into the liquefied store 20 where the gas acts on the liquefied oxygen surface 26 to restore pressure.

The pressure control valve 23 operates to control the pressure in the pressure build-up circuit. The valve 22 is closed during filling to prevent gas purged from the store 20 entering the pressure build up circuit. A pressure relief valve 24 is provided to relieve excess pressure.

It will be appreciated that to maintain the oxygen liquefied in a liquefied state and prevent uncontrolled heat gain, the feed line 11 is insulated. Also, the liquefied oxygen store 20 is well insulated and usually would comprise a dewar having a vacuum surrounding the container actually containing the liquefied gas.

Because liquefied oxygen and other liquefied gases have such a low thermal conductivity this means that it can take a considerable time for thermal equilibrium to be reestablished after filling or topping up the liquefied oxygen store 20 with liquefied oxygen gas.

Thus in accordance with the invention, in the feed line 11, between the source 12 of liquefied oxygen and the liquefied oxygen converter 13, there is provided an uninsulated flow region 16 through which the liquefied oxygen flows during filling. As the liquefied oxygen flows, heat energy will be gained in the uninsulated flow region such that the temperature of the liquefied oxygen introduced into the liquefied oxygen store 20, is nearer to the temperature of a surface region 26 of the liquefied oxygen in the store 20.

Thus it has been found that the thermal equilibrium of the system subsequent to filling is much more quickly re-established.

The uninsulated flow region 16 may be provided by a simple container through which the liquefied oxygen flows during filling, although preferably the uninsulated flow region 16 is provided by a device having an inlet 16*a* which is connected to a part 11*a* of the feed line 11 which extends to inlet valve 18 and the liquefied oxygen source 12, and an outlet 16*b* which is connected to the remaining pair 11*b* of the feed line 11 which extends to the liquefied oxygen converter 13. The device 16 may comprise an uninsulated passage or passages whose lengths or combined lengths is/are greater than the distance from the inlet 16*a* to the outlet 16*b* of the device 16 so as to save space and provide a productive uninsulated length of flow region.

In another example, the device 16 may comprise an inlet and an outlet (combined or separate) and a chamber with a capacity greater than that of an equivalent length of feed line 11 so as to have a greater wetted surface area than the equivalent length of feed line 11. In each case, the device 16 is constructed so that the liquid oxygen therein gains sufficient energy to raise the temperature in the dewar 20 during the temperature stabilisation phase.

Such an uninsulated flow region 16 may be retro-fitted to an existing gas supply system thus to reduce the duration of the thermal stabilisation phase of a liquefied oxygen converter 13, by interrupting the feed line 11 thereof. In that event it would not be necessary to adapt or otherwise disturb the existing liquefied oxygen converter 13. However such an uninsulated flow region 16 may be particularly usefully be provided upon installation of the gas supply system, where the installer is not able to or is unwillingly to interfere with the operation of the liquefied oxygen converter 13, to reduce the duration of the thermal stabilisation phase from that which would otherwise be required.

Of course the capacity of the uninsulated flow region 16 and the wetted surface area of the liquefied oxygen therein would need to be compatible with the capacity of the liquefied oxygen store 20 with which it is to be used, and the system 10 generally. However in general the capacity of the uninsulated flow region 16 is likely to be in the order of 5% to 15% of the volume of the liquefied oxygen store 20, and more typically in the order of 7% to 10%. If the capacity of the uninsulated flow region 16 is too great, this will not reduce the duration of the thermal stabilisation phase further, but will result in wastage of liquefied oxygen.

In one specific example the invention was applied to a liquefied oxygen converter 13 have a liquid gas store 20 of a capacity of about 25 liters.

The uninsulated flow region comprised four tubes each about 30 cm long and having a diameter of about 5 cm, through which the liquefied oxygen was made to flow. The tubes were each made of stainless steel having a wall thickness of just less than 1 mm.

It will be appreciated that the diagrammatic drawing of the FIGURE does not show all the components which may be contained in an operative system. For example, a non return valve or some other appropriate means would be required to prevent the liquefied oxygen flowing out of the store 20 to the uninsulated flow region 16. One possibility is to mount the uninsulated flow region 16 (or at least a part of it) above the level of the normal surface layer 26 of the liquefied oxygen in the store 20 so that back flow of the liquefied oxygen is prevented by gravity.

The liquefied oxygen feed line 28 within the liquefied oxygen converter 13, between the feed line 11 and the product gas outlet 17, may contain a valve which may close or be closed to prevent wastage of liquefied oxygen during filling. The line 28 may also contain a non-return valve to prevent back flow of oxygen gas.

Various modifications are possible to the example described. For example only, the uninsulated flow region 16 and feed line 11 may be equipment provided by a ground support apparatus rather than being provided in the aircraft structure. Thus valve 18 may be positioned between the liquefied oxygen converter 13 and the uninsulated flow region 16. Moreover the uninsulated flow region may comprise two parts with the inlet valve 18 interposed therebetween.

If desired, only a portion of the liquefied gas may be made to pass through an uninsulated flow region.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

What is claimed is:

1. A method of reducing the duration of the thermal stabilisation phase of liquefied gas converter comprising providing in a feed line between a source of liquefied gas and the liquefied gas converter, an uninsulated flow region through which at least a portion of the liquefied gas passes during filling, the uninsulated flow region having a capacity of between 5% and 15% of the volume of the liquefied gas store of the gas converter.

2. A method according to claim 1 wherein that the uninsulated flow region has a capacity of between 7% and 10% of the volume of the liquefied gas store of the gas converter.

3. A method according to claim 1 wherein the method includes interrupting the feed line and connecting an inlet of the flow region to a part of the feed line which extends to the liquefied gas store, and connecting an outlet of the flow region to a part of the feed line which extends to the liquefied gas converter.

4. A method according to claim 1 wherein the method includes locating the uninsulated flow region in an environment which is at ambient temperature.

5. A method according to claim 1 wherein the liquid gas is oxygen or nitrogen.

6. An apparatus for reducing the duration of the thermal stabilisation phase of a liquefied gas converter having in combination a liquefied gas converter and an apparatus for reducing the duration of the thermal stabilisation phase of the liquefied gas converter, the apparatus comprising a liquefied gas feed linebetween a source of liquefied gas and the liquefied gas converter, and a product gas outlet, the apparatus further comprising an uninsulated flow region located in the feed line through which at least a portion of the liquefied gas passes during filling of a liquefied gas store of the liquefied gas converter, the uninsulated flow region having a capacity of between 5% and 15% of the volume of the liquefied gas store of the liquefied gas converter.

7. An apparatus according to claim 6 wherein the uninsulated flow region comprises an inlet and an outlet and a flow passage or passages between the inlet and the outlet of a length or combined length which is substantially greater than the distance from the inlet to the outlet.

8. An apparatus according to claim 6 wherein the uninsulated flow region comprises an inlet and an outlet and a chamber having a capacity greater than of an equivalent length of feed line.

9. The apparatus of claim 6, wherein the feed line enters the liquefied gas store at a location below a surface level of the liquefied gas stored therein.

10. The apparatus of claim 9, wherein the uninsulated flow region includes an inlet end and an outlet end separated by a first length, and wherein the portion of the liquefied gas passing through the uninsulated flow region flows along a flow path defined by at least one flow passage having a total length greater than the first length.

11. The apparatus of claim 9, wherein the uninsulated flow region includes an inlet end and an outlet end separated by a first length, the uninsulated flow region further including a chamber, the chamber having a volume and a wetted area greater than a volume and a wetted area defined by an equivalent length of the feed line.

12. A method of adapting a gas supply system comprising a liquefied gas converter, a feed line to the liquefied gas converter for replenishing a liquefied gas store of the liquefied gas converter, and a product gas outlet for product gas produced by the liquefied gas converter, the method comprising installing in the feed line an uninsulated flow region through which at least a portion of the liquefied gas flows during filling of the liquefied gas store, the uninsulated flow region having a capacity of between 5% and 15% of the volume of the liquified gas store of the gas converter, whereby the duration of the thermal stabilisation phase of the liquefied gas converter subsequent to filling, is reduced.

13. In combination a liquified gas converter and an apparatus for reducing the duration of the thermal stabilisation phase of the liquified gas converter, the apparatus comprising an insulated flow region located in the feed line through which at least a portion of the liquefied gas passes during filling of a liquefied gas store of the liquefied gas converter and the uninsulated flow region having a capacity of between 5% and 15% of the volume of the liquefied gas store of the gas converter.

* * * * *